US007481409B1

(12) United States Patent
Reynolds

(10) Patent No.: US 7,481,409 B1
(45) Date of Patent: Jan. 27, 2009

(54) LABORATORY EASEL

(75) Inventor: Cedric S. Reynolds, Greensboro, NC (US)

(73) Assignee: Stovall Life Science, Inc., Greensboro, NC (US)

( * ) Notice: Subject to any disclaimer, the term of this patent is extended or adjusted under 35 U.S.C. 154(b) by 8 days.

(21) Appl. No.: 11/724,511

(22) Filed: Mar. 15, 2007

(51) Int. Cl.
*A47B 19/00* (2006.01)

(52) U.S. Cl. ..... 248/441.1; 248/456; 108/1

(58) Field of Classification Search ..... 248/441.1, 248/454–456, 118.3; 108/1, 6, 9, 12; 52/167.5
See application file for complete search history.

(56) References Cited

U.S. PATENT DOCUMENTS 289,394 A * 12/1883 Danner ..... 248/456
3,686,780 A * 8/1972 Sheehan ..... 248/445
4,199,173 A * 4/1980 Greenlees ..... 281/45
4,467,727 A * 8/1984 Strommer ..... 108/23
4,664,039 A * 5/1987 Schneider ..... 108/6
5,564,844 A * 10/1996 Patterson et al. ..... 400/492
5,651,525 A * 7/1997 Yang ..... 248/456
5,657,956 A * 8/1997 Smith et al. ..... 248/371

* cited by examiner

*Primary Examiner*—Korie Chan

(57) ABSTRACT

An easel for laboratory work having a transparent top and a furrowed bottom for support and better observation of laboratory equipment positioned on a counter or other horizontal surface. A cylindrical spacer is placed within one of the bottom furrows to bias the top at a desired angle for convenient viewing during precision laboratory operations such as when using a pipette. A friction pad can be placed on the top for securing a pipette well plate holder or other laboratory apparatus.

12 Claims, 5 Drawing Sheets

LABORATORY EASEL

FIELD OF THE INVENTION

The invention herein pertains to laboratory equipment and specifically pertains to an easel for use on a laboratory counter for adjustably supporting a well plate holder or other equipment during routine procedures.

DESCRIPTION OF THE PRIOR ART AND OBJECTIVES OF THE INVENTION

Accuracy is required in laboratory processes and often scientists, laboratory technicians and others must carry out routine tests and experiments over extended time periods. Many procedures can become tiresome, requiring the users to bend their necks and backs for better observation. For example, observing well plates while pipetting at an angle normal to the laboratory counter permits the best view and increases the user's efficiency. However, this often requires the user to stretch or bend the back and neck muscles which can increase physical strain and cause discomfort.

In order to help overcome the difficulties and physical exertions during laboratory work, the present invention was conceived and one of its objectives is to provide an easel which is easily adjusted for holding pipette well plates, laboratory slides, containers and the like during involved processes.

It is still another objective of the present invention to provide an easily adjustable easel which can be employed on a counter and adjusted in only a few moments to a durable angle.

It is still another objective of the present invention to provide a laboratory easel having a durable, rigid top and bottom which are hingedly joined and which are adjustable by using a cylindrical spacer selectively positioned therebetween.

It is a further objective of the present invention to provide a laboratory easel which utilizes a friction pad as necessary to help releasably secure selected equipment to the easel.

Various other objectives and advantages of the present invention will become apparent to those skilled in the art as a more detailed description is set forth below.

SUMMARY OF THE INVENTION

The aforesaid and other objectives are realized by providing a suitably dimensioned laboratory easel which is positional on a horizontal laboratory counter or other chosen area. The easel consists of a top and a bottom which are each substantially planar and are hingedly joined along one edge with a durable polymeric hinge. The hinge is secured to the top and bottom with a series of short, threadable fasteners which allow the top to pivot from the bottom for desirable height angles. The hinge is made from a thin polymeric strap such as nylon which will not fail during normal repetitive use. A cylindrical spacer such as a hollow acrylic tube is included to selectively position between the top and bottom within one of a series of lateral furrows formed in the upper surface of the bottom. As would be understood by placing the spacer in the furrow closest to the hinge the angle between the top and bottom is wider (greater) whereas placing the spacer in the furrow farthest from the hinge provides a more narrow angle and a lesser pivot. The top of the easel is formed from a transparent material such as from a rigid transparent acrylic to allow the user to easily see the spacer therebeneath and make pivotable adjustments of the easel as suitable. A conventional friction pad which may be for example 2-4 mm in thickness can be placed over the top to prevent sliding of equipment supported by the angled easel top.

DETAILED DESCRIPTION OF THE PREFERRED EMBODIMENT AND OPERATION OF THE INVENTION

Figure 1:
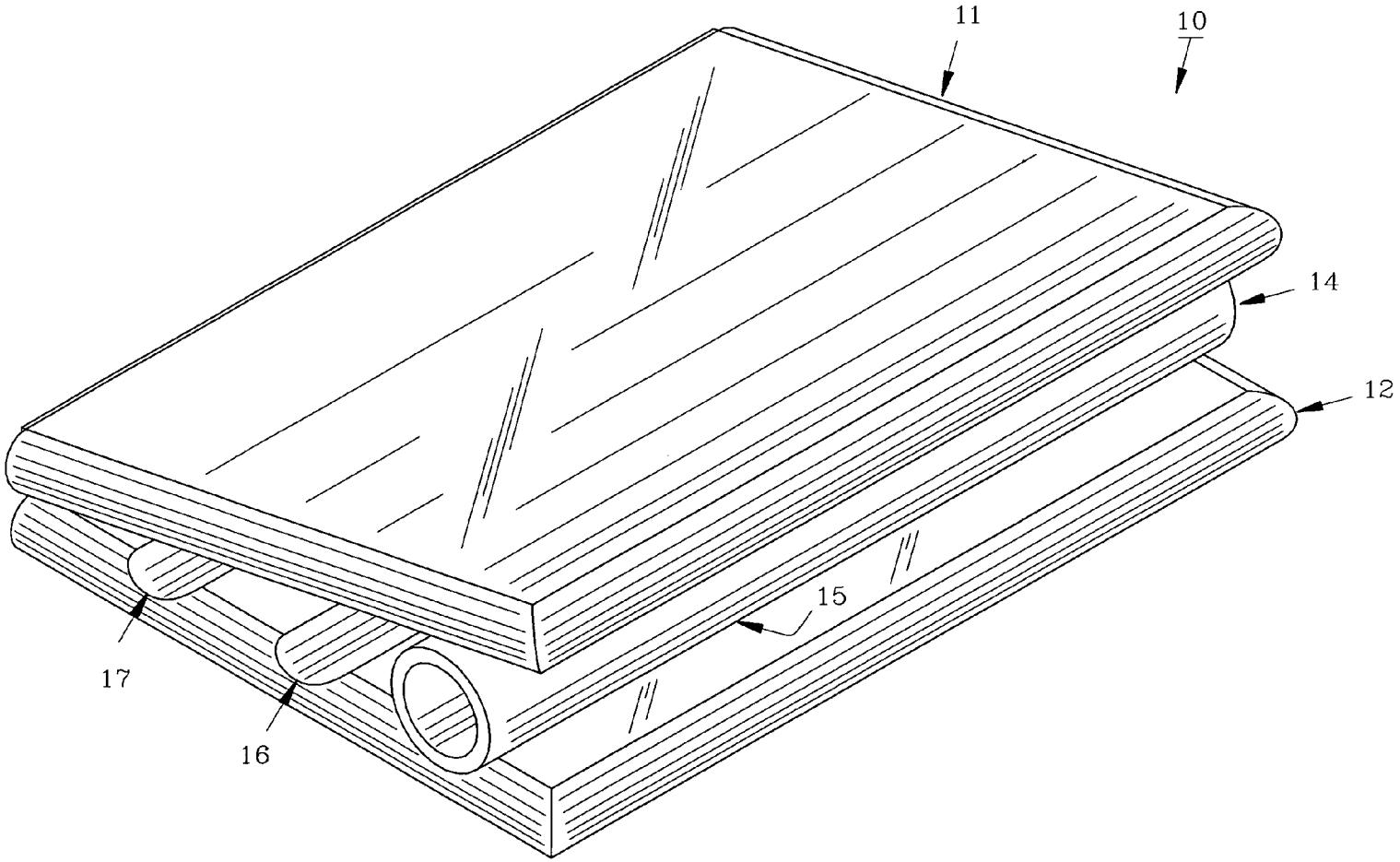
FIG. 1 shows a top, front left side perspective view of the easel of the invention.

For a better understanding of the invention and its operation, turning now to the drawings, FIG. 1 demonstrates easel 10, the preferred form of the invention having rigid top 11 and rigid bottom 12 both of rectangular shape. Top 11 and bottom 12 are formed from planar, transparent acrylic sheets and may be sized preferably, approximately 10 mm thick, 14 cm long and 10 cm wide. Other sizes, materials and shapes could likewise be employed depending on the specific needs of the user. Bottom 12 includes first furrow 15, second furrow 16 and third furrow 17 for selective placement of spacer 14 shown positioned in first furrow 15 in FIG. 1 for minimal pivoting of top 11 from bottom 12. Spacer 14 is preferrably hollow and cylindrically shaped with an outer diameter of 25 cm for optimum use in furrows 15, 16 and 17 which are sized accordingly.

Figure 2:
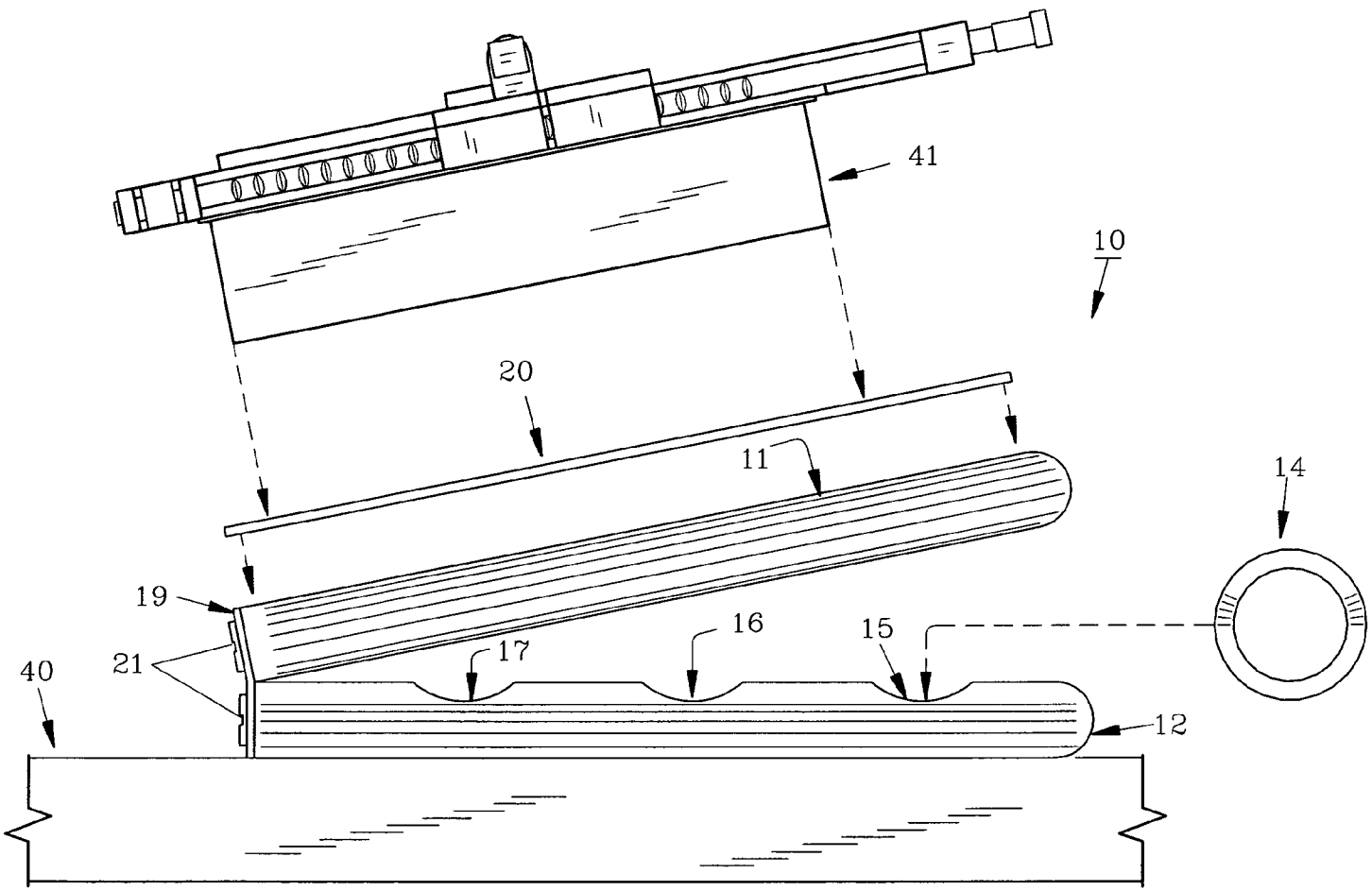
FIG. 2 illustrates a left side elevational view of the easel as seen in FIG. 1 positioned on a laboratory counter with the spacer exploded therefrom and shown in combination with a friction pad and laboratory well plate holder, both exploded therefrom, the right side elevational view (not shown) being a mirror image thereof.
Figure 4:
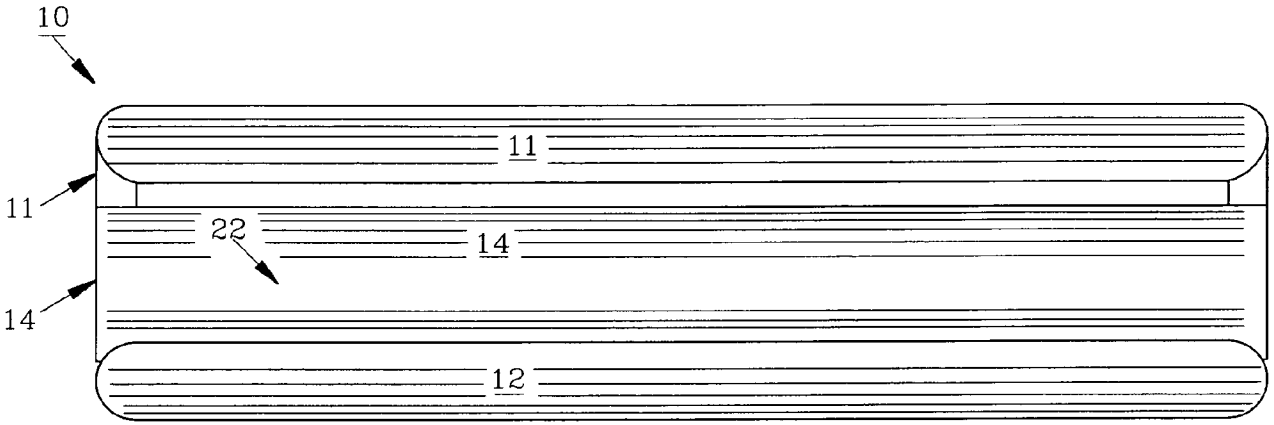
FIG. 4 demonstrates a front elevational view thereof.

For use, easel 10 is placed on a flat surface such as laboratory counter 40 shown in FIG. 2 and a standard friction pad 20 is placed on top 11 for securing standard pipette plate holder 41 thereon. Friction pad 20 prevents movement of pipette plate holder 41 during use. Friction pad 20 is formed from a standard resilient rubber-like polymeric material sized to adequately cover top 11. Furrows 15, 16 and 17 allow ease in adjusting the desired angle of top 11 from bottom 12 while using conventional pipette plate holder 41 or for other uses. As would by understood, by adjusting the angle of top 11 to bottom 12 the user can more precisely and conveniently view the work being performed thereon, for example with pipette plate holder 41. While first furrow 15, second furrow 16 and third furrow 17 are shown in bottom 12, more or less furrows could likewise be placed therein with different sizes and dimensions for various top 11 adjustment angles.

Figure 3:
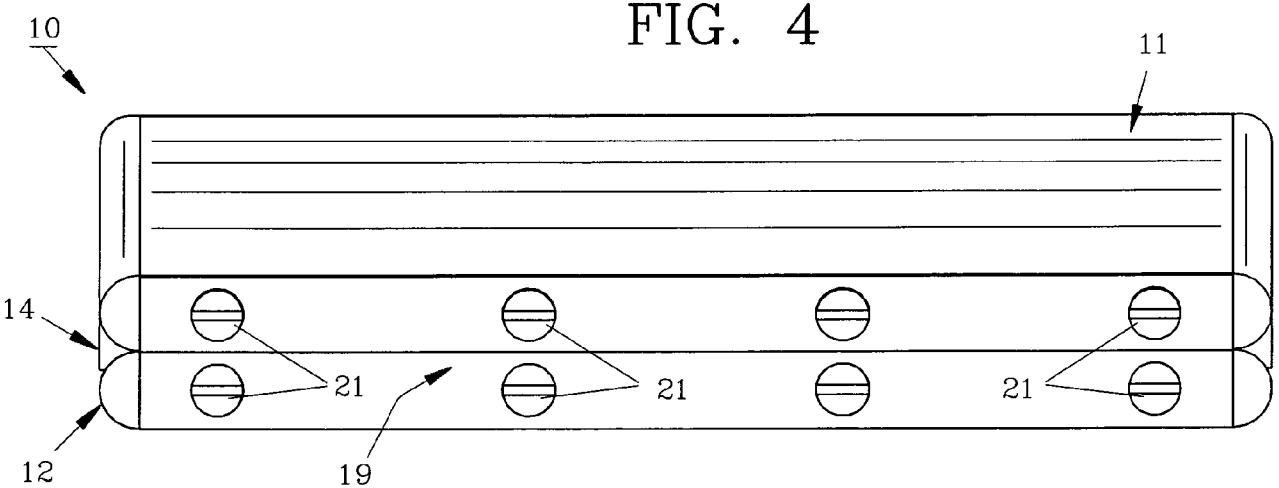
FIG. 3 depicts a rear elevational view of the easel featured in FIG. 1.
Figure 5:
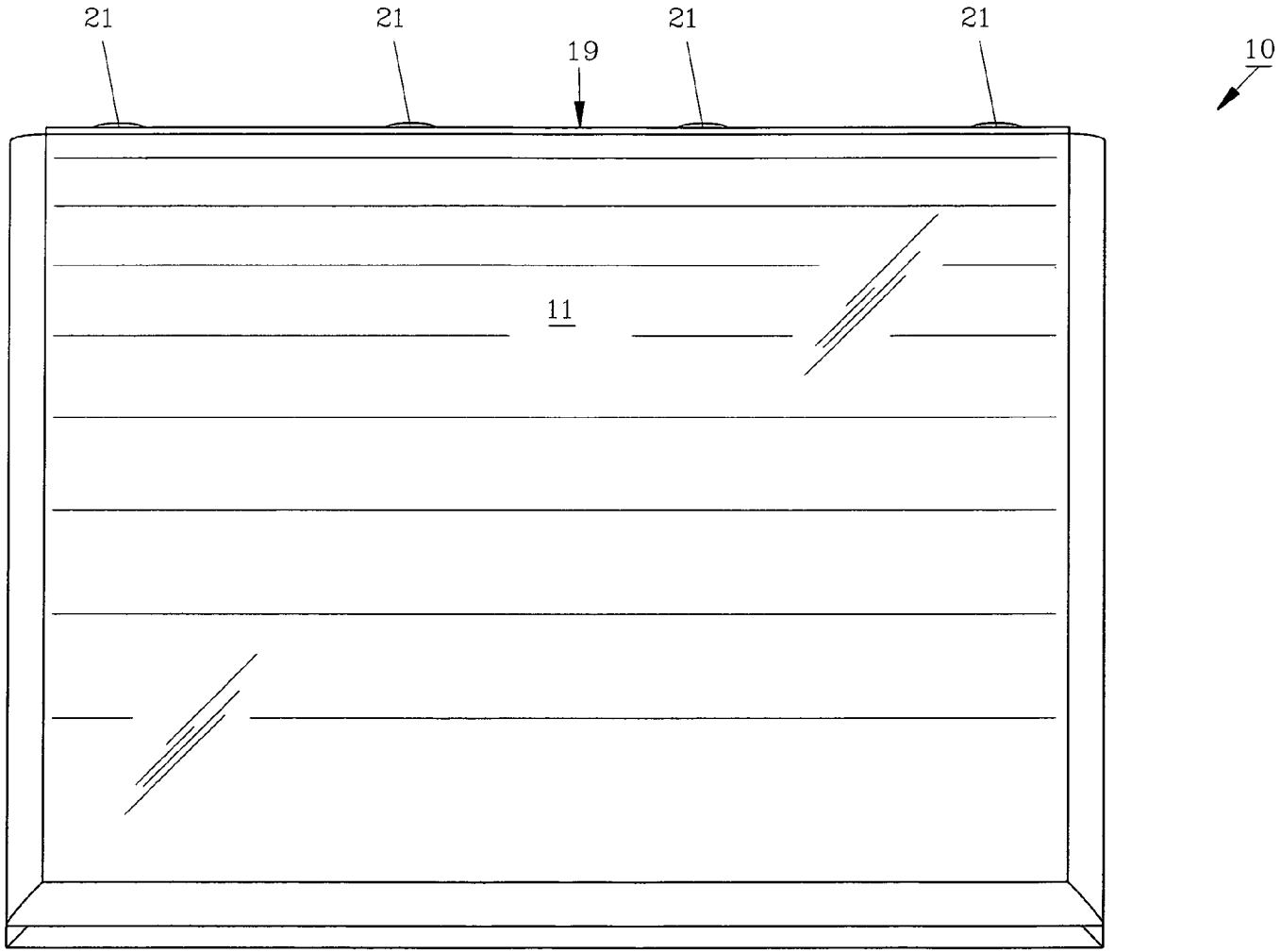
FIG. 5 illustrates a top plan view of the easel as seen in FIG. 1.
Figure 6:
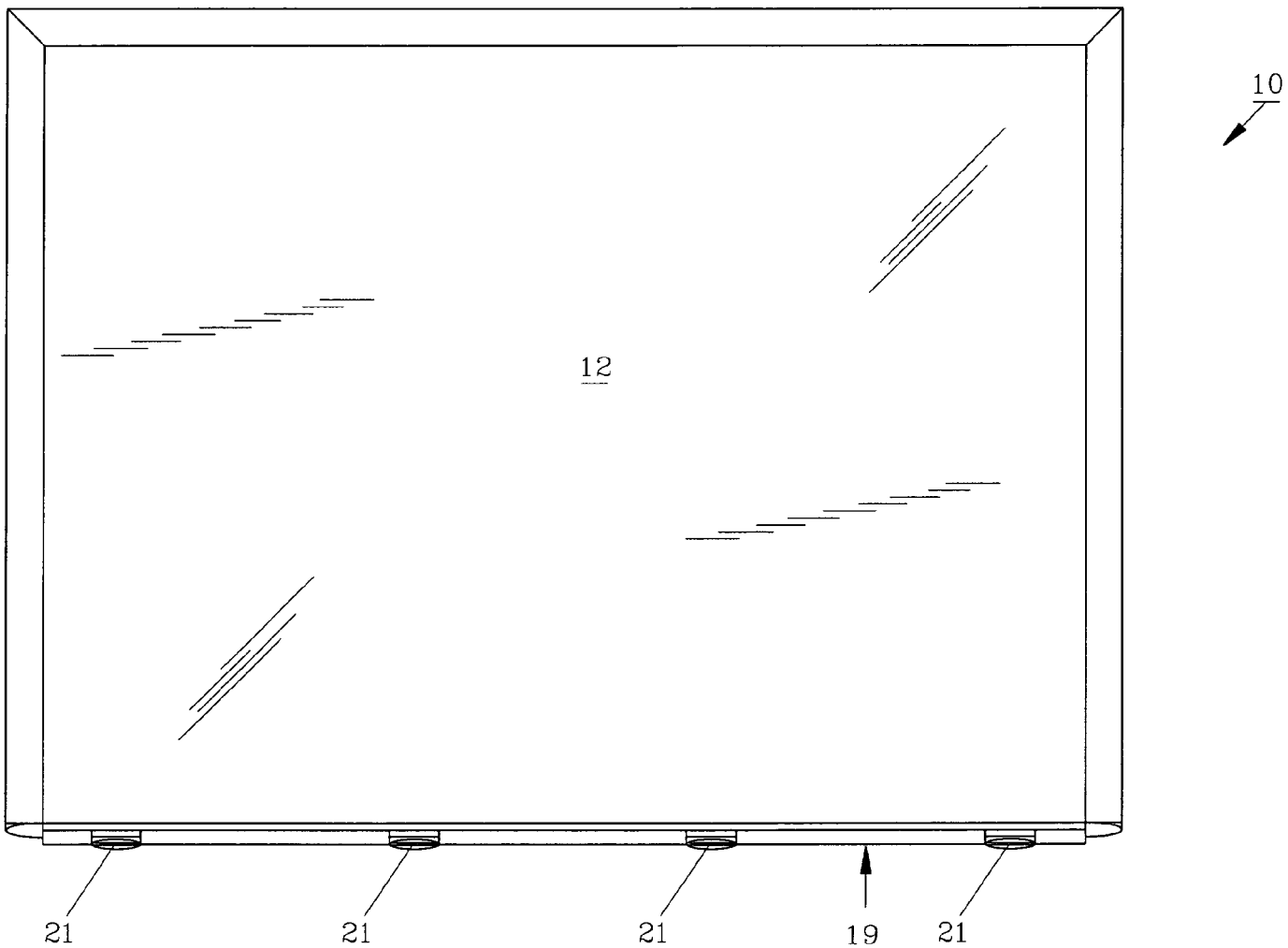
FIG. 6 pictures a bottom plan view of the easel as seen in FIG. 1.

A rear view of easel 10 is shown in FIG. 3 with hinge 19 affixed to the rear outer edges of top 11 and bottom 12 with flat headed screws 20 spaced therealong. Hinge 19 is formed from a durable, flexible polymeric material such as a nylon strap which will withstand thousands of flections without fatigue along center line 22. After use of easel 10, pipette plate holder 41 or other equipment is removed therefrom. Friction pad 20 and spacer 14 are also removed and cleaned as required. Easel 10 can then be folded (closed) for compact storage until future use.

The illustrations and examples provided herein are for explanatory purposes and are not intended to limit the scope of the appended claims.

I claim:

1. An easel comprising: a top, a bottom, a hinge, said hinge joined to said top and said bottom and extending substantially the entire lateral dimension of said easel, said top defining a planar bottom surface, said bottom defining a first furrow, a hollow, cylindrical spacer, said spacer having a length equivalent to the lateral dimension of said easel, said spacer positioned in said first furrow.

2. The easel of claim 1 wherein said bottom defines a second furrow.

3. The easel of claim 1 wherein said top is transparent.

4. The easel of claim 1 further comprising a friction pad, said friction pad positioned on said top.

5. The easel of claim 1 wherein said hinge is formed from a polymeric material.

6. An adjustable easel comprising: a top, a bottom, said top and said bottom having an identical length and width, a hinge, said hinge extending substantially alone the lateral outer edge of said top and said bottom, fasteners, different ones of said fasteners attaching said hinge to said top and to said bottom, said bottom defining a plurality of furrows, a hollow cylindrical spacer, said spacer positioned in one of said plurality of furrows for separating said top and said bottom.

7. The easel of claim 6 wherein said top is planar.

8. The easel of claim 6 wherein said top is formed from a rigid polymeric material.

9. The easel of claim 6 wherein said top comprises an acrylic material.

10. The easel of claim 9 wherein said acrylic is transparent.

11. The easel of claim 6 wherein said bottom has a flat surface.

12. The easel of claim 6 further comprising a friction pad, said friction pad positioned on said top for receiving an object thereon.

* * * * *